US006754965B1

(12) United States Patent
Kretchman

(10) Patent No.: US 6,754,965 B1
(45) Date of Patent: Jun. 29, 2004

(54) INTEGRATED SANDWICH CRIMPING TOOL

(76) Inventor: Len C. Kretchman, P.O. Box 206, Lake City, SD (US) 57247

( * ) Notice: Subject to any disclaimer, the term of this patent is extended or adjusted under 35 U.S.C. 154(b) by 66 days.

(21) Appl. No.: 09/724,271

(22) Filed: Nov. 28, 2000

(51) Int. Cl.[7] ..... B26B 3/00; B65D 77/00; B65D 23/12; B65D 41/04

(52) U.S. Cl. ..... 30/316; 30/314; 30/315; 206/216; 215/228; 215/329; 215/386; 220/212; 220/288

(58) Field of Search ..... 30/316, 314, 315; 99/450.1, 450.2, 450.3; D18/14; 206/216; 220/278, 288, 212; 215/329, 228, 386; 426/94, 274, 275, 297, 138

(56) References Cited

U.S. PATENT DOCUMENTS 1,963,635 A * 6/1934 Wainwright ..... 215/334
2,042,028 A * 5/1936 Skutch ..... 215/334
2,089,007 A * 8/1937 Skutch ..... 215/334
2,170,386 A * 8/1939 Merolle ..... 215/334
3,339,812 A * 9/1967 Meissner ..... 222/566
4,625,890 A * 12/1986 Galer ..... 220/319
4,711,363 A * 12/1987 Marino ..... 220/266
4,770,305 A * 9/1988 Su ..... 215/250
4,793,503 A * 12/1988 Towns et al. ..... 215/250
4,836,396 A * 6/1989 Ancona et al. ..... 206/457
5,387,149 A * 2/1995 Caveza ..... 100/137
5,505,326 A * 4/1996 Junko ..... 220/278
5,788,099 A * 8/1998 Treu et al. ..... 215/230
5,947,318 A * 9/1999 Palm ..... 220/278
5,954,561 A * 9/1999 Cannone ..... 434/127
5,967,352 A * 10/1999 Repp et al. ..... 215/256
6,004,596 A * 12/1999 Kretchman et al. ..... 426/274
6,170,683 B1 * 1/2001 Montgomery ..... 215/235
RE37,243 E * 6/2001 Molinaro et al. ..... 215/256

* cited by examiner

*Primary Examiner*—Allan N. Shoap
*Assistant Examiner*—Isaac N Hamilton
(74) *Attorney, Agent, or Firm*—Kinney & Lange, P.A.

(57) ABSTRACT

An integrated container crimping and cutting tool arrangement having a tub with an opening therein providing access to an otherwise surrounded volume, and a cover mountable on the tub having an opening at which the cover can be releasably mounted on the tub to prevent immediate access to the surrounded volume therein. In addition, this arrangement has a closed wall structure provided as a portion thereof having an ending edge terminating a closed wall which also has a crimping edge thereon offset away from the ending edge to allow pressing it against a sandwich to cut out center portions thereof leaving sealed bread edges.

28 Claims, 2 Drawing Sheets

INTEGRATED SANDWICH CRIMPING TOOL

BACKGROUND OF THE INVENTION

The present invention relates to sealed crustless sandwiches and, more particularly, relates to a tool for forming sealed crustless sandwiches.

Sandwiches are usually made with vegetables, various kinds of spreads, or meat as fillings between two slices of bread, or some combination thereof as fillings between such a pair of bread slices. Such fillings, however, often leak out or are squeezed out the sides of the sandwich between the slices of bread making the storing or eating, or both, of such sandwiches somewhat messy.

In addition, bread is commonly baked in an oven of some sort to thereby result in a loaf having harder crust portions on the outside thereof about the softer inner portions of that loaf. Some individuals do not enjoy heating, and so do not wish to eat, such outer crust portions as part of a sandwich.

As a result, sealed crustless sandwiches have been developed. Such a sandwich can seal for a substantial period of time the internal sandwich filling against leaking or squeezing out the sides of the sandwich between the bread slices. Furthermore, sealed crustless sandwiches are made by crimping in such a manner as to also cut away the interior portions of the bread slices about the filling in forming the crustless sealed sandwich while discarding the outer crusts.

The making of such sealed crustless sandwiches has been done on a commercial basis with machines and tooling designed for that purpose. Such apparatus is costly and unavailable as a practical matter to consumers. Thus, there is a desire to provide an arrangement whereby consumers can prepare and form on their own behalf such sealed crustless sandwiches.

BRIEF SUMMARY OF THE INVENTION

The present invention provides an integrated container crimping and cutting tool apparatus having a tub with an opening therein providing access to an otherwise surrounded volume, and a cover mountable on the tub having an opening at which the cover can be releasably mounted on the tub to prevent immediate access to the surrounded volume therein. In addition, this apparatus has a closed wall structure provided as a portion thereof having an ending edge terminating a closed wall which also has a crimping edge thereon offset away from the ending edge. The closed wall structure can be part of the cover or part of the tub, and can have two wall thickness portions on which to form the crimping and ending edges.

DETAILED DESCRIPTION

Figure 1:
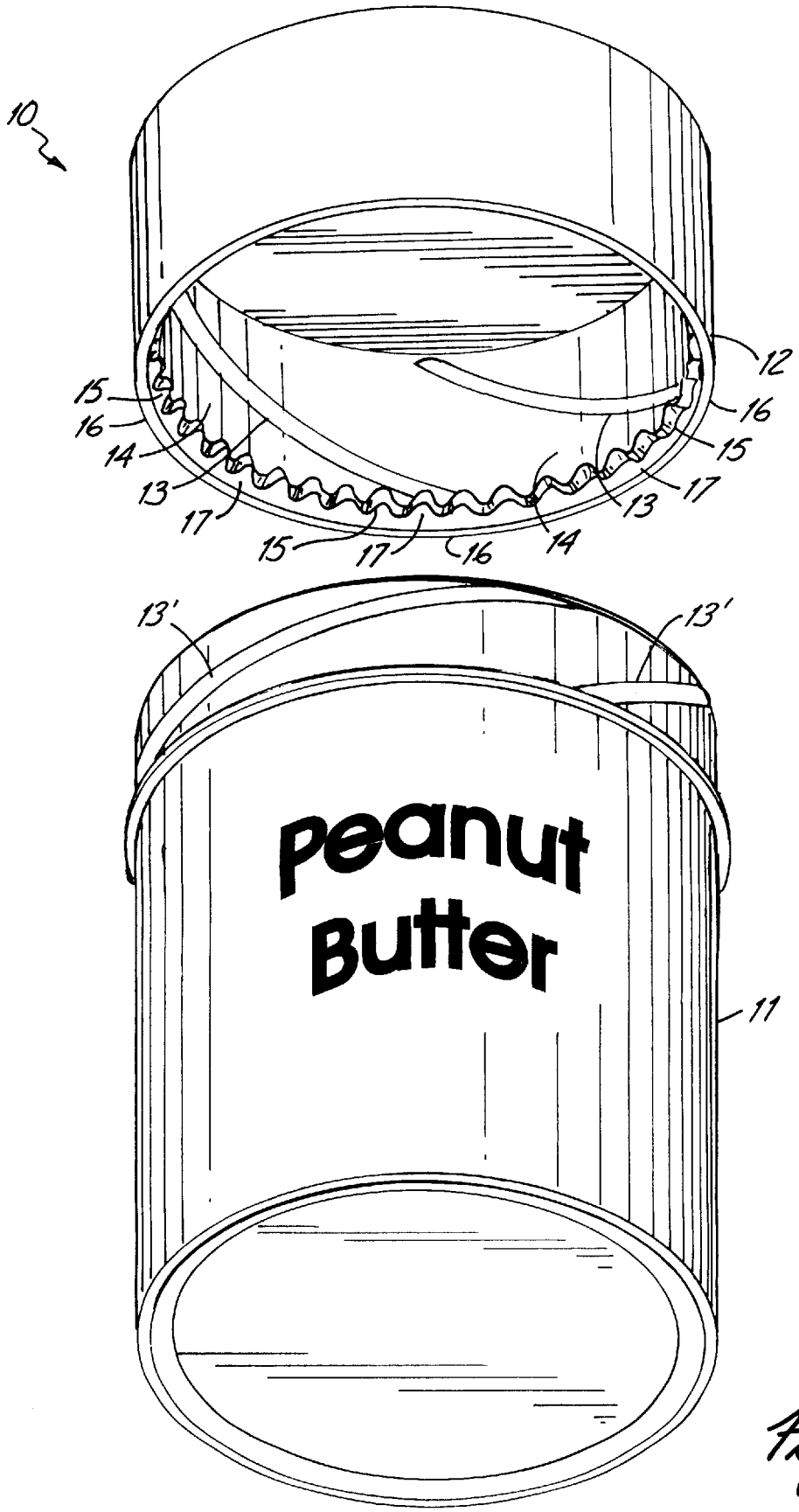
FIG. 1 shows a perspective view of an embodiment of the present invention.

FIG. 1 is a perspective view of an containing arrangement, 10, for one or another of various kinds of possible sandwich fillings such as spreads, here shown labeled as containing peanut butter, a common kind of spread used as a filling in sandwiches. Container 10 has a tub portion, 11, formed of a truncated cylindrical shell with also a circular plate bottom to close off one end of that shell to thereby result in tub 11, or walled vessel provided about an interior space or volume, accessible through an open end of the cylindrical shell. Tub 11 can be formed of a suitable container material such as plastic, glass, etc.

In addition, containing arrangement 10 is provided with a releasably mountable cover portion, 12, that can be releasably mounted on container tub 11 at the end of the shell opposite the circular plate bottom to limit access to the contents of tub 11 provided in the interior space. Cover 12 is also formed as a truncated cylindrical shell, though of differing shell wall thicknesses, with again a circular plate to close off one end of that shell to result in cover 12 with an open end. Suitable container cover materials can be used such as plastic, metal, etc. The interior of the cylindrical shell portion of cover 12 has threads, 13, formed on an inner surface thereof which can engage and rotate along a further set of threads, 13', formed on the outer surface of the cylindrical shell portion of tub 11 near the open end thereof. Positioning the open end of cover 12 over the open end of tub 11 to allow threads 13 in cover 12 to engage threads 13' on the outside of the shell of tub 11, followed by rotating cover 12 in one direction with respect to tub 11, causes cover 12 to be pulled down tightly on tub 11 to prevent access to the inner space of tub 11, i.e. closes containing arrangement 10. Rotation of cover 12 in the opposite direction removes cover 12 to thereby provide access to the inner space of tub 11, i.e. open that arrangement. Alternative cover mounting means can be instead used to releasably close the container.

Cover 12 has threads 13 thereof formed on a thickened wall portion, 14, of the cylindrical shell provided in that cover (in addition to the thickness of threads 13). Thickened wall portion 14 extends as the cylindrical shell from the inner surface of the circular plate in cover 12 to an undulating edge, 15, near that open edge, 16, of the cylindrical shell to leave a thinned wall portion, 17, as part of the cover cylindrical shell between edge 15 of thickened wall portion 14 and edge 16 of the cylindrical shell. Thinned wall portion 17 of the cover cylindrical shell thus provides an offset space or region between undulating surface 15 of thickened wall cylindrical shell portion 14 and edge 16 of the open end of the cylindrical shell.

Such an arrangement allows a possessor of container 10 to form a sealed crustless sandwich with two slices of bread. The possessor places one slice of bread on a surface and further places the desired filling for the sandwich on the central portions of that slice, perhaps also including there the peanut butter spread from container 10 or such other spread as may be chosen. Thereafter, the second slice of bread is placed over the filling and the first slice of bread so as to leave the first and second slices of bread aligned in such a way as to have their similar curved portions of the outline of each directly across from one another.

The sandwich maker can then position the open end of cover 12 on the second, or upper, slice of bread just within the crust edges thereof, and force cover 12 against this sandwich construct, and so the surface supporting the first slice of bread, to thereby crimp the two slices of bread together within the space of the offset between this support surface and undulating edge 15. Edge 16 is forced at the same time through both slices of bread to sever the central portions thereof within the diameter of edge 16 with the filling therebetween from the remaining outer portions of the two slices of bread which are primarily the crusts.

Figure 2:
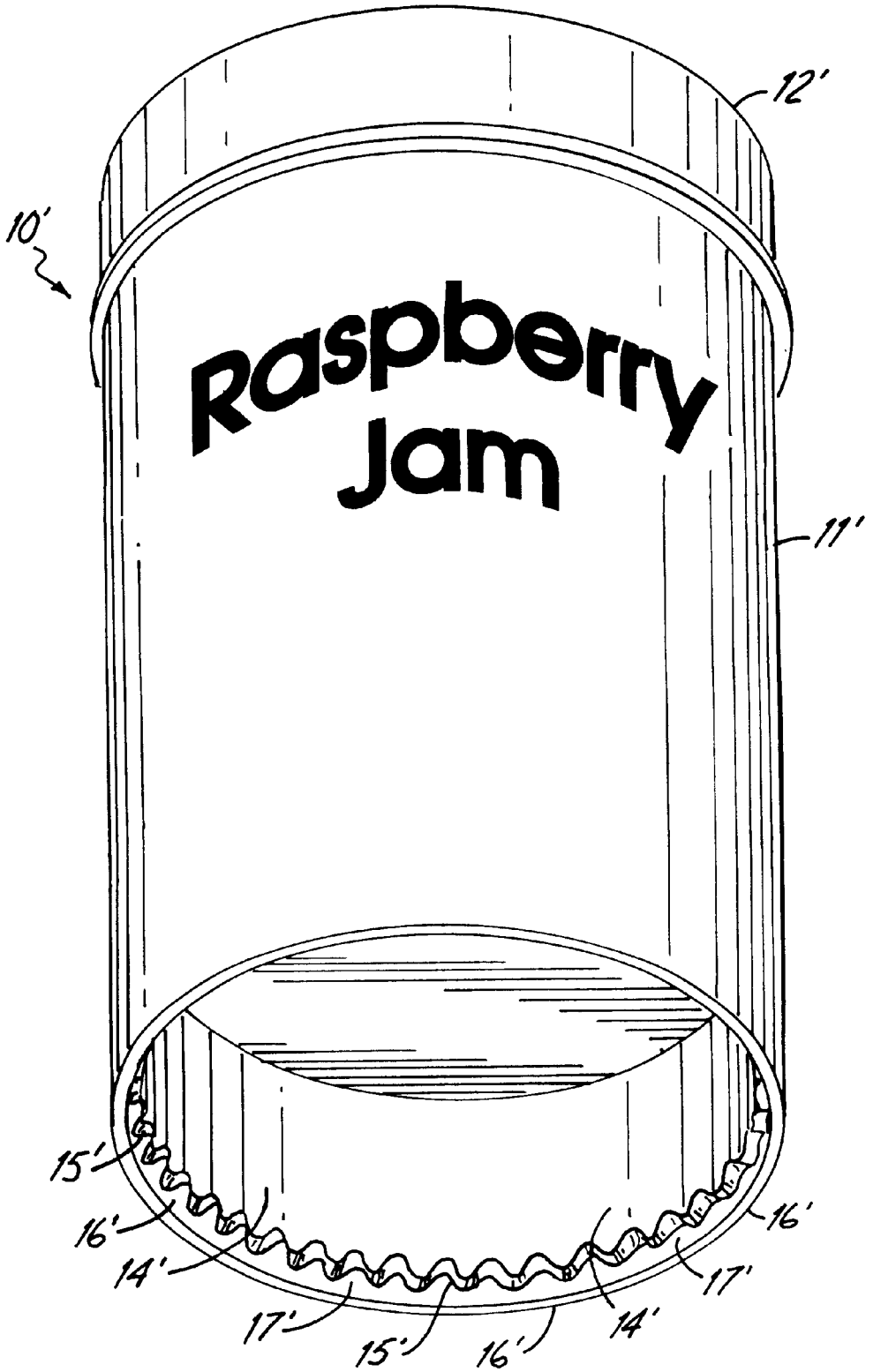
FIG. 2 shows a perspective view of an alternative embodiment of the present invention.

An alternative embodiment of the present invention is shown in the perspective view of FIG. 2 of a containing arrangement, 10'. Again there is provided a tub portion, 11', formed of a truncated cylindrical shell with a circular plate bottom to close off the interior space of that shell toward one end of that shell to result in tub 11' with a first open end providing access to that interior space. There is also provided a releasably mountable cover portion, 12', that can be releasably mounted on container tub 11, and is formed as a truncated cylindrical shell of a single wall thickness (except possibly for the cover mounting means) with a circular plate to close off one end to result in cover 12' with an open end. Any releasable mounting arrangement for releasably mounting cover 12' on tub 11' can be used.

Tub 11' has a second open end which does not provide access to the open space provided by its first open end provided by an extension of the tub cylindrical wall past the interior space closing circular plate such that this wall extension forms a skirt below the closing plate. This skirt has a thickened wall portion, 14'. Thickened wall portion 14' extends as the cylindrical shell from the outer surface of the closing circular plate in tub 11' to an undulating edge, 15', near a skirt open edge, 16', to leave a thinned wall portion, 17', as part of the skirt between edge 15' of thickened wall portion 14' and edge 16' of the skirt. Thinned wall portion 17' of the tub skirt thus provides an offset space or region between undulating surface 15' of thickened wall skirt portion 14' and edge 16' of the open end of that skirt. Tub 11' can be formed as a single plastic structure.

Such an arrangement again allows a possessor of container 10' to form a sealed crustless sandwich with two slices of bread just as described above. The sandwich maker can again position the open end of the skirt of tub 11' on the second, or upper, slice of bread just within the crust edges thereof, and force tub 11' against this sandwich construct, and so the surface supporting the first slice of bread, to thereby crimp the two slices of bread together within the space of the offset between this support surface and undulating edge 15'. Edge 16' is again forced at the same time through both slices of bread to sever the central portions thereof within the diameter of edge 16' with the filling therebetween from the remaining outer portions of the two slices of bread which are primarily the crusts.

A further alternative has the skirt with the thick and thin cylindrical wall portions and the associated crimping and end edges formed as a separate structure that can be pressed onto a tub like tub 11 to be around a portion of the outside thereof, and that can removed therefrom as desired for use in forming crustless sealed sandwiches. Such a structure could, for example, serve as a base for the tub when provided thereon during times the spread container is being stored. Such a structure can be formed of plastic that yields slightly to permit sliding it over the outside of tub 11.

Although the present invention has been described with reference to preferred embodiments, workers skilled in the art will recognize that changes may be made in form and detail without departing from the spirit and scope of the invention.

What is claimed is:

1. An integrated container crimping and cutting tool apparatus, said apparatus comprising:

a tub having an opening therein with edges thereabout, said tub opening providing access to an otherwise surrounded volume;

a cover having a sealing location therein at which said cover can be releasably mounted on said tub to thereby selectively prevent immediate access through said tub opening to said surrounded volume in said tub, and with said cover being selectively positionable in being released from such access by at least being rotatable with respect to said tub about an axis oriented at an angle to a plane defined by said tub opening edges; and a closed wall structure provided as a portion of said apparatus having a closed wall therein formed about an interior region with an ending edge at an end thereof, said closed wall structure also having a crimping edge substantially all of which is adjacent to said closed wall and all of which is positioned away from said ending edge by an axial distance alongside said closed wall adjacent said interior region as an offset said crimping edge being peripherally enclosed by said closed wall thereabout, said crimping edge also being about and adjacent to at least a portion of said interior region with said interior region extending past said crimping edge on either side thereof in directions substantially paralleling said offset by at least a distance equal to said offset.

2. The apparatus of claim 1 wherein said crimping edge undulates away and toward said ending edge.

3. The apparatus of claim 1 wherein said crimping edge is about a corresponding cross section of said interior region that is smaller than that cross section of said interior region corresponding to said ending edge.

4. The apparatus of claim 1 wherein said closed wall structure is part of said cover.

5. The apparatus of claim 1 wherein said closed wall structure is part of said tub.

6. The apparatus of claim 4 wherein said cover has two wall thickness portions.

7. The apparatus of claim 5 wherein said tub has a skirt on an end thereof opposite that end thereof on which said cover is mountable, said skirt having two wall thickness portions.

8. The apparatus of claim 6 wherein said crimping edge undulates away and toward said ending edge.

9. The apparatus of claim 6 wherein said crimping edge terminates at least a part of a thicker one of said two wall portions within said ending edge which terminates a thinner one of two said wall portions.

10. The apparatus of claim 7 wherein said crimping edge undulates away and toward said ending edge.

11. The apparatus of claim 7 wherein said crimping edge terminates at least a part of a thicker one of said two wall portions within said ending edge which terminates a thinner one of two said wall portions.

12. The apparatus of claim 1 wherein said cover is rotatable with respect to said tub about more than one axis.

13. The apparatus of claim 12 wherein said cover is rotatable with respect to said tub about any selected axis.

14. The apparatus of claim 13 wherein said cover, when released from preventing such access, is completely disconnected from said tub.

15. An integrated container crimping and cutting tool apparatus, said apparatus comprising:

a tub having an opening therein with edges thereabout, said tub opening providing access to an otherwise surrounded volume;

a cover having a sealing location therein at which said cover can be releasably mounted on said tub to thereby selectively prevent immediate access through said tub opening to said surrounded volume in said tub, and with said cover being selectively positionable, when released from being mounted to prevent such access, by being separable from said tub to thereby be positionable independent of positions of said tub; and a closed wall structure provided as a portion of said apparatus having a closed wall therein formed about an interior region with an ending edge of an end thereof, said closed wall structure also having a crimping edge substantially all of which is adjacent to said closed wall and all of which is positioned away from said ending edge by an axial distance alongside said closed wall adjacent said interior region as an offset said crimping edge being peripherally enclosed by of said closed wall thereabout, said crimping edge also being about and adjacent to at least a portion of said interior region with said interior region extending past said crimping edge on either side thereof in directions substantially paralleling said offset by at least a distance equal to said offset.

16. The apparatus of claim 15 wherein said crimping edge undulates away and toward said ending edge.

17. The apparatus of claim 15 wherein said crimping edge is about a corresponding cross section of said interior region that is smaller than that cross section of said interior region corresponding to said ending edge.

18. The apparatus of claim 15 wherein said closed wall structure is part of said cover.

19. The apparatus of claim 18 wherein said cover has two wall thickness portions.

20. The apparatus of claim 19 wherein said crimping edge undulates away and toward said ending edge.

21. The apparatus of claim 19 wherein said crimping edge terminates at least a part of a thicker one of said two wall portions within said ending edge which terminates a thinner one of said two wall portions.

22. An integrated container crimping and cutting tool apparatus, said apparatus comprising:

a tub having an opening therein with edges thereabout, said tub opening providing access to an otherwise surrounded volume;

a cover having a sealing location therein at which said cover can be releasably mounted on said tub to thereby selectively prevent immediate access through said tub opening to said surrounded volume in said tub, and with said cover being selectively positionable in being released from preventing such access; and a closed wall structure provided as a portion of said apparatus having a closed wall therein formed about an interior region with an ending edge at an end thereof such that said surrounded volume has a volume substantially exceeding that of said interior region, said closed wall structure also having a crimping edge substantially all of which is adjacent to said closed wall and all of which is positioned away from said ending edge by an axial distance alongside said closed wall adjacent said interior region as an offset said crimping edge being peripherally enclosed by said closed wall thereabout, said crimping edge also being about and adjacent to at least a portion of said interior region with a closed wall structure provided as a portion of said apparatus having a closed wall therein formed about an interior region with an ending edge at an end thereof such that said surrounded volume has a volume substantially exceeding that of said interior region, said closed wall structure also having a crimping edge substantially all of which is adjacent to said closed wall but offset back away from said ending edge so as to be at least partially enclosed by at least a portion of said closed wall thereabout, said crimping edge also being about and adjacent to at least a portion of said interior region with said interior region extending past said crimping edge on either side thereof in directions substantially paralleling said offset by at least a distance equal to said offset.

23. The apparatus of claim 22 wherein said crimping edge undulates away and toward said ending edge.

24. The apparatus of claim 22 wherein said crimping edge is about a corresponding cross section of said interior region that is smaller than that cross section of said interior region corresponding to said ending edge.

25. The apparatus of claim 22 wherein said closed wall structure is part of said cover.

26. The apparatus of claim 25 wherein said cover has two wall thickness portions.

27. The apparatus of claim 26 wherein said crimping edge undulates away and toward said ending edge.

28. The apparatus of claim 26 wherein said crimping edge terminates at least a part of a thicker one of said two wall portions within said ending edge which terminates a thinner one of two said wall portions.

* * * * *